US008834212B2

(12) United States Patent
Meinherz

(10) Patent No.: US 8,834,212 B2
(45) Date of Patent: Sep. 16, 2014

(54) ELECTRICAL CONTACT ELEMENT HAVING A PRIMARY AXIS

(75) Inventor: Manfred Meinherz, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 155 days.

(21) Appl. No.: 13/574,644

(22) PCT Filed: Jan. 7, 2011

(86) PCT No.: PCT/EP2011/050150

§ 371 (c)(1),
(2), (4) Date: Jul. 23, 2012

(87) PCT Pub. No.: WO2011/089035

PCT Pub. Date: Jul. 28, 2011

(65) Prior Publication Data

US 2012/0295492 A1 Nov. 22, 2012

(30) Foreign Application Priority Data

Jan. 22, 2010 (DE) ..... 10 2010 005 945

(51) Int. Cl.
*H01R 13/187* (2006.01)
*H01H 1/38* (2006.01)

(52) U.S. Cl.
CPC ..... *H01H 1/385* (2013.01)
USPC ..... 439/843; 439/851

(58) Field of Classification Search
CPC ..... H01R 13/11; H01R 13/111; H01R 13/18; H01R 13/187
USPC ..... 439/839, 840, 843, 851
See application file for complete search history.

(56) References Cited

U.S. PATENT DOCUMENTS

| | | | | |
|---|---|---|---|---|
| 1,742,246 | A | 1/1930 | Garroway | |
| 4,701,136 | A | 10/1987 | Madeley | |
| 5,147,227 | A * | 9/1992 | Yurko | 439/733.1 |
| 5,468,164 | A | 11/1995 | Demissy | |
| 5,676,571 | A * | 10/1997 | Matthews | 439/843 |
| 5,775,960 | A * | 7/1998 | Saito et al. | 439/843 |
| 5,897,404 | A * | 4/1999 | Goodman et al. | 439/843 |
| 5,921,822 | A * | 7/1999 | Kennedy et al. | 439/851 |
| 7,658,657 | B1 * | 2/2010 | Scanzillo et al. | 439/825 |
| 8,317,552 | B2 * | 11/2012 | Leroyer et al. | 439/839 |

FOREIGN PATENT DOCUMENTS

| | | | |
|---|---|---|---|
| DE | 19718448 | A1 | 11/1998 |
| DE | 69414062 | T2 | 4/1999 |
| GB | 2171856 | A | 9/1986 |

* cited by examiner

*Primary Examiner* — Thanh Tam Le
(74) *Attorney, Agent, or Firm* — Laurence A. Greenberg; Werner H. Stemer; Ralph E. Locher

(57) ABSTRACT

An electrical contact element has a primary axis. The primary axis pierces a polygonal base surface of the contact element. A contact bushing is arranged around the primary axis. An orifice of the contact bushing opens into a top surface which is arranged on a side of the contact element lying opposite to the base surface. The top surface bulges spherically over the base surface and transitions continually into a lateral face connecting the base surface and top surface.

10 Claims, 5 Drawing Sheets

ELECTRICAL CONTACT ELEMENT HAVING A PRIMARY AXIS

BACKGROUND OF THE INVENTION

Field of the Invention

The invention relates to an electrical contact element having a primary axis which pierces a polygonal base surface of the contact element and a contact bushing arranged around the primary axis, the orifice of which bushing opens into a top surface which is arranged on a side of the contact element lying opposite to the base surface.

An electrical contact element of this kind is disclosed, for example, in U.S. Pat. No. 5,468,164. The contact element therein has a hexagonal base surface. A contact bushing of the electrical contact element is arranged around a primary axis which penetrates the base surface of the contact element. The contact bushing has an orifice which lies in a top surface and which is arranged on a side of the contact element lying opposite the base surface.

In the region of the base surface, the contact element has a prism-shaped form which receives the hexagonal structure of the base surface and has a corresponding hexagonal sleeve surface around the primary axis starting from straight lines of the base surface running between the corners. To form a top surface of the electrical contact element, the contact element is designed in two parts, wherein a first part has an external thread and a second part an internal thread. The two parts are connected to one another by means of the thread. The contact bushing opens into the top surface. As well as the edges running in the direction of the primary axis, step-like discontinuous changes in cross-section are also provided in the sleeve surface.

The contact bushing of the contact element can be more easily brought into contact with a contact pin by means of a funnel-like extension of the contact bushing towards the top surface, as the contact pin is centered during a movement in the direction of the primary axis.

Although, with an embodiment of this kind, contact with the electrical contact element is made more easily, discharges at the contact bushing or at the electrical contact element are to be expected in the case of higher voltages due to the dielectrically unfavorable shape.

Furthermore, the space required for the contact arrangement is large due to the radial projection of the contact bushing, which extends in a funnel-like manner. Particularly when miniaturization is required, a structurally large contact arrangement of this kind has been shown to be disadvantageous.

BRIEF SUMMARY OF THE INVENTION

It is therefore the object of the invention to design a contact arrangement in such a way that the dimensions are compact while the performance capability is high and reliable operation at high voltage loadings is ensured.

According to the invention, the object is achieved with an electrical contact element of the kind mentioned in the introduction in that the top surface is spherically curved and spans the base surface, while a sleeve surface which connects the base surface and the top surface merges continuously from the polygonal base surface into the spherical top surface.

By way of example, a polygonal base surface can be triangular, rectangular, pentagonal, hexagonal or generally multisided. The polygonal base surface should be flat. The primary axis should extend substantially perpendicular to the base surface. This enables a straight sleeve contour of the electrical contact element with axes which lie substantially perpendicular to one another. In the case of a polygonal base surface, it can in particular be provided that the corners of the base surface are eradicated, in particular rounded off in the form of a circular arc, thus avoiding projecting pointed edges.

The top surface with the spherical curvature should likewise be arranged symmetrically with respect to the primary axis and span the base surface as homogeneously and uniformly as possible. At the same time, the spherical curvature should be curved convexly about the orifice of the contact bushing so that a transition which is as continuous and steady as possible takes place from the spherical curvature of the top surface to the sleeve surface which encompasses the base surface. A sleeve contour which is as free as possible from projections and edges can be formed particularly when the corners of the base surface are rounded and the edges which extend into the sleeve surface starting from the corners of the base surface are correspondingly rounded. In doing so, it can be provided that at least one contacting element is arranged in the contact bushing of the electrical contact element. The contacting element can be elastically deformable, for example. Possible examples of contacting elements of this kind are contact fingers, contact springs which are inserted in the form of a ring, contact leaves etc. At the same time, the contacting elements are arranged entirely in the interior of the electrical contact element, i.e. within the sleeve contour, wherein an electrically conducting connection is provided between the contact element and the movable contacting elements arranged in the contact bushing so that a permanent current path exists within the electrical contact element via the electrically conducting connection to the movable contact elements. In this way, the electrical contact element with its base body, which has the polygonal base surface, the top surface and the sleeve surface, can itself serve as part of the current path.

By choosing a polygonal base surface, it is possible, for example, to arrange a plurality of contact elements closely adjacent to one another in the region of the base surface. This enables the power density of an electrical power which is to be transmitted by adjacent contact elements to be increased. In contrast to normally used contact elements with rotationally symmetrical sleeve contour, clefts can be avoided and available space used more effectively.

A further advantageous embodiment can provide that, on its side facing the base surface, the sleeve surface is designed at least partially in the manner of a sleeve surface of a truncated pyramid, and the spherical top surface, rounded in the manner of an ellipsoid, merges continuously with the sleeve surface of the truncated pyramid while eradicating body edges.

If the sleeve surface is formed on the base surface in the manner of a truncated pyramid, i.e. starting from the base surface, the sleeve contour of the electrical contact piece tapers towards the spherical top surface, a cooling medium, for example a gaseous cooling medium, can circulate between a plurality of contact elements at least in the transition region to the spherical top surface, even when they are arranged closely together. Current-generated heat can be radiated and fed away from the surface of the electrical contact element.

Furthermore, it is possible to use the base surface of the contact element for making electrical contact with the contacting element. For example, the base surface can be placed on an electrical current track, thus providing a large area via which a current can pass from the current track into the contact element. The current passing into the base surface can be transferred by means of the electrically conducting connection via the movable contacting elements arranged inside the contact bushing to a contact pin which is likewise inserted into the contact bushing. As a result of the increased surface area compared with the contact points of the contacting element, less heating occurs at the base surface than in the contact bushing itself. This enables the current-generated heat, which is produced as a result of the contact resistance in the contact bushing, to be conducted away from the electrical contact arrangement.

As a result of an ellipsoidal design of the spherical top surface, the orifice is advantageously encompassed by a structure which is rounded in the form of a ring. Advantageously, the ellipsoid is formed in the manner of a spherical cap which merges into the sleeve surface. The orifice can be in the form of a circular cutout in the spherical cap. An ellipsoidal shape which deviates from an ideal sphere also enables adequate dielectric screening of the orifice. In addition, a spherical cap has the advantage that its dielectric effect on adjacent components in the region of the spherical top surface does not change when the contact element rotates about the primary axis. The polygonal base surface is remote from the dielectrically screened region of the orifice so that an embodiment in the form of a truncated pyramid is advantageous here. The pyramid-like angled parts of the sleeve surface in the region of the base surface of the contact element enable a simplified transition to the spherically curved top surface, as the truncated-pyramid-shaped basic form tapers towards the orifice. A continuous transition from the truncated-pyramid-shaped basic form to the spherical top surface takes place continuously free from sudden surface changes.

A further advantageous embodiment can provide that, on its side facing the base surface, the sleeve surface is designed at least partially in the manner of a sleeve surface of a prism, and the spherical top surface, rounded in the manner of an ellipsoid, merges continuously with the sleeve surface of the prism while eradicating body edges.

Unlike a tapering truncated pyramid, with a prism, a cross section, which initially has a constant circumference over a larger distance towards the top surface, is provided on the contact element. In this way, sufficient wall thickness can be provided around the bushing as far as the region of the contact bushing to also conduct larger currents through larger cross sections from the base surface of the contact element towards the bushing.

Here too, it can be provided that the ellipsoidal top surface advantageously constitutes a spherical cap within which an orifice of the contact bushing lies.

Furthermore, it can advantageously be provided that the continuous transition to the spherical top surface takes place using sections which lie on a sleeve surface of a circular cylinder.

In order to effect a homogenized transition between the polygonal base surface and the spherical ellipsoidal top surface, it can be provided that, as an alternative to an immediate transition of a truncated-pyramid-shaped or prism-shaped sleeve surface to the spherical top surface, at least one section of the sleeve surface of the contact element corresponds to a section of a sleeve of a circular cylinder. At the same time, the (imaginary) circular cylinder should preferably be aligned coaxially with respect to the primary axis, wherein, for example, the diameter of the circular cylinder corresponds to a chord through a focus of an ellipsoidal cross section of the spherical top surface. By way of example, it can be provided that a perpendicular bisector, which, for example, is approximately perpendicular to the base surface, is constructed in a side of the polygonal base surface. A correspondingly rounded-off body edge protrudes, for example, from a truncated-pyramid-shaped sleeve surface region starting from a side of the base surface ending in the spherical top surface following the perpendicular bisector. These additional body edges, which lie on the perpendicular bisector, run parallel to the primary axis and in each case are at the same radial distance from the primary axis so that the perpendicular bisector and the additional body edges aligned therewith lie in a sleeve surface of a circular cylinder.

With a prism-shaped design, the additional body edges run within the sleeve surface of the prism. In the case of a transition from the prism-shaped sleeve surface to the spherical top surface, portions of a circular-cylinder-shaped sleeve surface, for example a narrow ring or similar, can be used to produce a continuous transition from the base surface to the top surface.

A further embodiment can provide that body edges are eradicated in a rounded manner.

With a polygonal embodiment of a base surface, body edges form projecting shaped sections in the sleeve surface. These body edges should advantageously be eradicated in a rounded manner. On the one hand, this reduces the risk of injury on the contact elements and, on the other, the dielectric strength of the contact element is positively affected, as partial discharges preferentially form on projecting edges. Starting from the base surface, the body edges which run towards the top surface should be rounded off/truncated to an increasing extent towards the top surface, thus resulting in a continuous transition from an angular base surface to a top surface with ellipsoidal cross section.

As a result of rounding the body edges, it is further possible to create a homogenous transition from the polygonal base surface to the ellipsoidal top surface via a truncated-pyramid-shaped skirt or a prism-shaped skirt. In doing so, individual sections of the sleeve surface lying between the body edges bring to mind rectangles or trapeziums. At the same time, the sleeve surface with its body edges which lie in the sleeve surface can advantageously be eradicated in such a way that, starting from the base surface, the degree of eradication increases towards the orifice so that the body edges are increasingly resolved towards the spherical top surfaces and a spherically curved contour spans the base surface.

A further advantageous embodiment can provide that the sleeve surface is curved concavely.

Sections of the sleeve surface located in the sleeve surface between body edges can be curved concavely. A concave curvature permits the surface of the sleeve surface to be increased compared with a flat design and therefore the surface area on the contact element which is available for radiating current-generated heat to be increased. It is therefore possible to more easily dissipate current-generated heat from the interior of the contact piece, in particular from the contact bushing, via the increased surface area of the contact element. At the same time, the concave curvature is further suited to forming a simplified rounded transition to the body edges and to eradicate them in a rounded manner. This results in bulbous structures, which in turn enable a plurality of contact elements to be placed close to one another in the region of the base surface and, in the case of a high current loading, enable adequate circulation with a cooling medium. The sides which run between the corners of the base surface likewise have a convex curvature.

Furthermore, it can advantageously be provided that threaded holes are made in the base surface, the number of which corresponds to the number of corners of the base surface.

If the base surface is designed to receive threaded holes, it is easily possible to use the screened region within the sleeve contour formed by the sleeve surface and the spherical top surface to fix the contact element in the protection of the screening effect. In particular, when the contact element makes contact with a conductor via the base surface, it is possible to press the base surface against the conductor by means of bolts screwed into the threaded holes. On the one hand, this produces a high contact pressure between base surface and the adjacent conductor and, on the other, ensures a mechanical retention and positioning of the contact element against the conductor. As an example, the conductor can have a contact surface which is equal and opposite to the base surface and of the same cross section. Particularly when the contact element is arranged on a projecting molding, the sleeve surface can merge with the molding, thus resulting in a narrow joint gap between the conductor molding and the contact element. The molding can continue the contour of the sleeve surface of the contact element so that the dielectric form of the contact element is also transferred to the molding in the region of the base surface.

The use of the corners of the contact element enables wall thicknesses present in the base body to be fully utilized to enable even greater forces to be transmitted. Particularly in the case of a rotationally symmetrical structure of the contact bushing, clefts, which can be used to receive the threaded holes, are formed in the corners of the sleeve contour. In addition, other fixing variants for fixing the contact element can also be provided. For example, an individual central bolt which projects into the contact bushing can also be used for fixing the contact element.

A further advantageous embodiment can provide that the base surface and the top surface are connected to one another in one piece.

On the one hand, a one-piece connection of base surface and top surface enables the contact element to make contact via the base surface and, on the other, as a result of the one-piece design, the electrical potential of the base surface to be also carried over into the top surface and thus impress the same electrical potential throughout the sleeve contour of the contact element. Furthermore, a one-piece connection enables an opening for the contact bushing to be made in the contact element, for example by means of a casting process or a forging process. Furthermore, contact resistances within the contact element are reduced by a one-piece design. A current path between the base surface and the top surface which encompasses an orifice of the contact bushing has a lower electrical impedance due to the one-piece design. An electrical current can be conducted further within the contact element with relatively low losses. Base bodies made from electrically conducting materials, such as aluminum, copper and other ferrous and non-ferrous metals and alloys for example, are suitable for forming base surface and top surface.

A further advantageous embodiment can provide that the base surface and the top surface are electrically conducting.

An electrical conductivity of a surface enables a defined electrical potential to be specifically applied to this surface. This enables a defined potential control to be effected for other components. Particularly in the case of continuously curved projection-reduced bodies, this enables a homogenous distribution of field lines emanating from the surface so that a contact element according to the invention is encompassed by a homogenous electric field.

Furthermore, it can advantageously be provided that the contact bushing opens into both the top surface and into the base surface.

The contact bushing can be introduced into the contact element in the manner of a blind hole for example, i.e. the contact bushing is arranged blind within the contact element and is only immediately accessible and visible from its orifice in the top surface.

This has the advantage that the region in the base region of the blind design of the contact bushing can be used to distribute an electrical current from the base surface all around the contact bushing. Furthermore, when the base region of the contact bushing is appropriately sized, the contact bushing itself is stabilized by the base.

However, it can also be provided that the contact bushing completely penetrates the electrical contact element, i.e. the contact element is designed in the form of a sleeve. A design of this kind has been shown to be advantageous if a contact pin is to be fed into the contact bushing and the penetration depth of the contact pin is to be determined. In the case of a contact pin structure which is as cylindrical and uniform as possible, the depth of penetration into the contact bushing cannot be directly determined at its sleeve. If the base surface of the contact bushing is now penetrated, i.e. as well as its orifice in the top surface, the contact bushing also opens into the base surface, the penetration depth of a contact pin in the contact bushing can be checked in the top surface by eye contact or by other suitable means. Furthermore, it is possible for the contact bushing of the contact element to be additionally permeated by a flow of a cooling medium, for example a gas or a liquid, and an improved cooling is possible.

In the following, an exemplary embodiment of the invention is shown schematically in a drawing and subsequently described in more detail. In the drawing:

DESCRIPTION OF THE INVENTION

Figure 1:
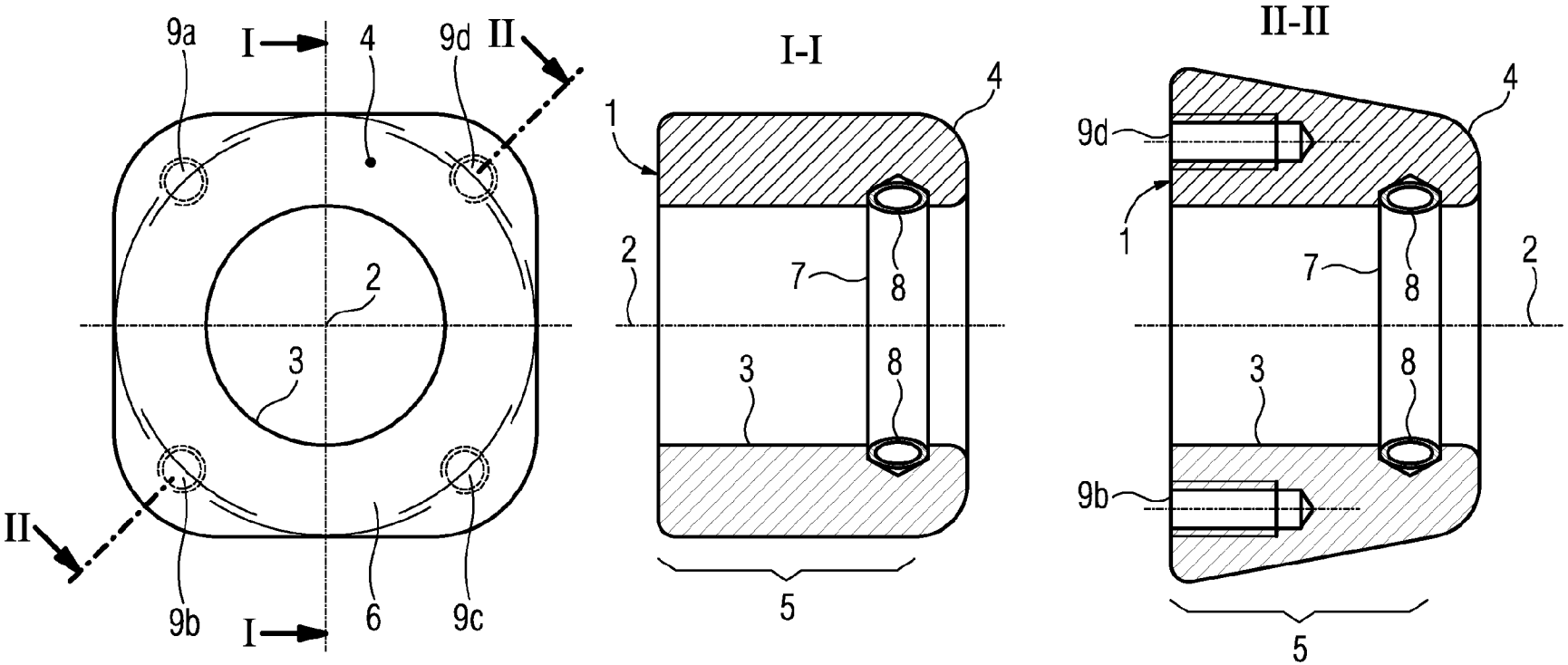
FIG. 1 shows an electrical contact element in a first embodiment in a plan view, in a cross section along the axis I-I and in a cross-section along the axis II-II.

In its first embodiment according to FIG. 1, the electrical contact element has a substantially square base surface 1 with four corners. The corners of the base surface 1 are eradicated in a rounded manner, thus essentially forming a base surface 1 with a square outline, the corners of which are rounded. A primary axis 2 is arranged perpendicular to the base surface 1. The primary axis 2 penetrates the base surface 1 centrally. In its first embodiment, the electrical contact element has a contact bushing 3 which is coaxial with respect to the primary axis 2. The contact bushing 3 penetrates the electrical contact element in the first embodiment along the whole of the primary axis 2 so that the contact bushing 3 constitutes a through opening in the electrical contact element of the first embodiment. At its side facing away from the base surface 1, the contact bushing 3 opens into a spherical top surface 4 which is aligned symmetrically with respect to the primary axis 2.

The spherical top surface 4 extends substantially in the form of a ring around the orifice of the contact bushing 3. Here, the spherical top surface 4 is a section of an ellipsoid which extends symmetrically around the primary axis 2. As an example, the spherical top surface 4 is a section of a sleeve surface of a spherical cap. Starting from the base surface 1, the electrical contact element of the first embodiment is encompassed by a sleeve surface 5 which runs around the primary axis 2 and is fed towards the spherical top surface 4. Here, the sleeve surface 5 is designed in such a way that the sleeve surface 5 tapers starting from the base surface 1 towards the spherical top surface 4 in the manner of a sleeve surface of a truncated pyramid. At the same time, the edges which lie in the sleeve surface of the pyramid are appropriately rounded off, wherein the roundings of the rounded corners of the base surface 1 are incorporated and continued towards the spherical top surface 4. In doing so, the rounded edges are increasingly rounded off towards the spherical top surface 4 in such a way as to form a continuous transition of the sleeve surface 5 with the rounded edges in the region of the base surface to the edge-free spherical top surface 4. The transition of the truncated-pyramid-shaped sleeve surface 5 to the spherical top surface 4 is shown symbolically in the plan view of the electrical contact element of the first embodiment by a contour line 6. The rotationally symmetrical design of the spherical top surface 4 and the rectangular base surface 1 results in a sleeve surface in the manner of a truncated pyramid. According to the section I-I, the sleeve surface has components which run parallel to the primary axis 2. Perpendicular bisectors, which are perpendicular to the base surface and which overlay the truncated-pyramid-like sleeve surface, extend from a median point on one side of the base surface 1. The perpendicular bisectors are aligned parallel to the primary axis 2 and enable the truncated-pyramid-like sleeve surface to be penetrated and a continuous transition to the spherical top surface. The perpendicular bisectors connect the base surface and the spherical top surface 4.

As a result of choosing a square base surface 1, in each case one perpendicular bisector is arranged in each of the sides of the base surface 1. The perpendicular bisectors are equally spaced from the primary axis 2 in a radial direction. The perpendicular bisectors lie distributed in the direction of the primary axis 2 on a circular path around the primary axis 2.

In the cross sections I-I and II-II, it can be seen that the contact bushing 3 extends through the whole of the electrical contact element so that the contact bushing 3 has orifices in the base surface 1 as well as in the spherical top surface 4.

The contact bushing 3 is equipped in its inner wall with a groove 7 which runs around the primary axis 2. At least one contacting element 8 is inserted in the groove 7. Here, the contacting element 8 is an inherently closed garter spring which is clamped in the groove 7 using its spring force. The contacting element 8 protrudes inwards into the opening of the contact bushing 3 in the radial direction. A contacting pin, for example, which at its outer circumferential surface can come electrically conductingly into contact with the contacting element 8, can therefore be fed into the contact bushing 3. For this purpose, the contacting element 8 is reversibly deformable and enables the electrical contact element to be electrically connected to the contact pin.

In the first embodiment according to FIG. 1, the base surface is bounded by linear straight lines which end in rounded corners.

Four threaded holes 9*a*, 9*b*, 9*c*, 9*d* are made in the base surface 1. The first embodiment of the electrical contact element can be fixed by means of the threaded holes 9*a*, 9*b*, 9*c*, 9*d*, for example the contact element can be screwed onto an electrical conductor, as a result of which the base surface 1 serves to make electrical and mechanical contact with the electrical conductor, and an electrically conducting connection is formed between the base surface 1 and the pressed-on electrical conductor. This electrically conducting connection is continued by walls of the electrical contact element as far as the contacting element 8 so that the electrical potential of a load-bearing electrical conductor is conducted as far as the contacting element 8.

Figure 2:
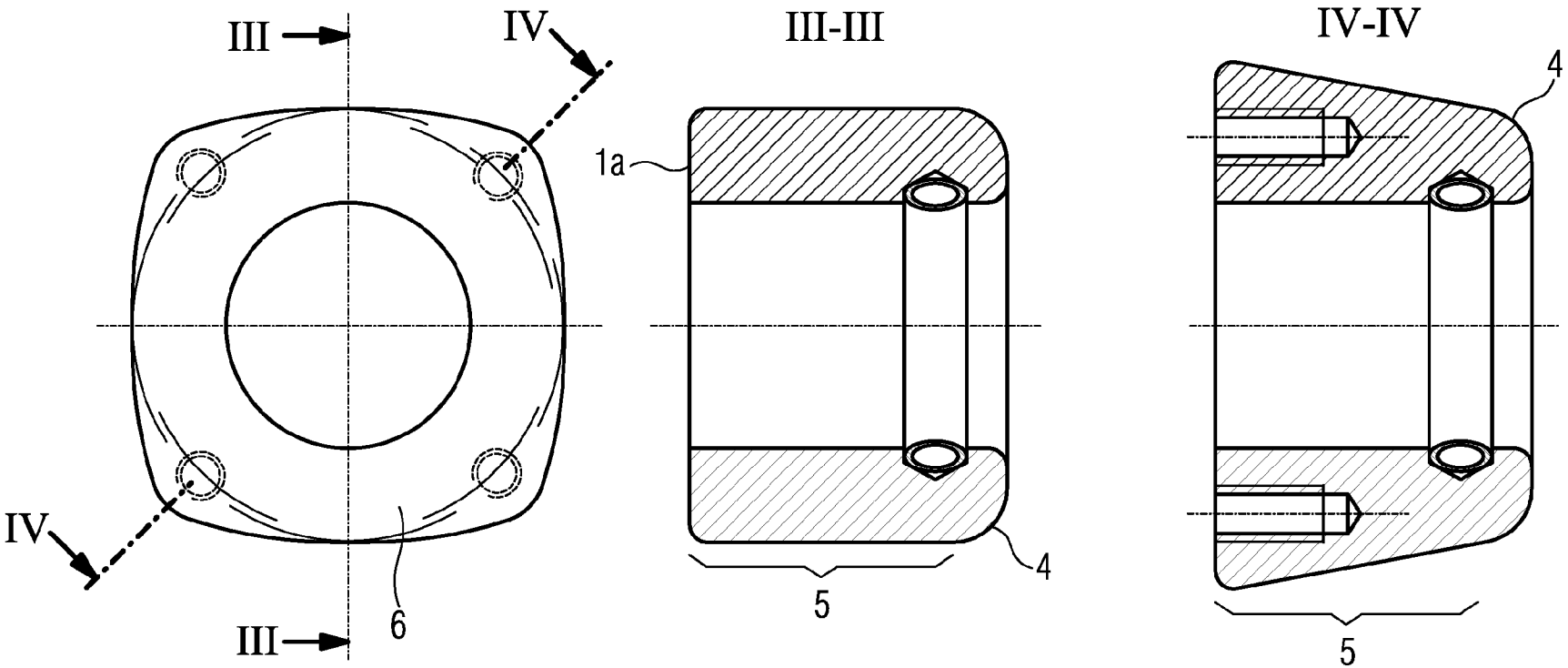
FIG. 2 shows a second embodiment of an electrical contact element in a plan view, in a cross section along the axis III-III and in a cross-section along the axis IV-IV.

Starting from FIG. 1, FIG. 2 shows an electrical contact element in a second embodiment. In the following FIGS. 2, 3, 4 and 5, the same references as known from FIG. 1 are used for elements which have the same effect. As the second embodiment of the electrical contact element according to FIG. 2 is based on a variation of the electrical contact element known from FIG. 1, only the differences between the first and the second embodiment will be discussed in the following. Basically, the design of the embodiments of the electrical contact element shown in FIGS. 1 and 2 is the same. The variant according to FIG. 2 varies only with regard to the design of the base surface 1*a*. In the second embodiment of the electrical contact element according to FIG. 2, the base surface 1*a* has a polygonal outline. The corners of the base surface 1*a* are rounded, as is also known from FIG. 1. However, the lines which connect the corners of the base surface 1*a* are curved convexly so that sections of the sleeve surface 5 consequently also have a concave curvature. The sections lie between the rounded body edges of the sleeve surface 5.

With the embodiment according to FIG. 2, as with the first embodiment according to FIG. 1, due to the radial extension of the spherical top surface 4, a transition is provided from the spherical top surface 4 to the substantially truncated-pyramid-shaped sleeve surface 5 using a section of a sleeve surface of a circular cylinder. Unlike an ideal truncated pyramid, perpendicular bisectors can therefore be found in the sleeve surface running parallel to the primary axis 2 (cf. FIG. 2, Section III-III).

Figure 3:
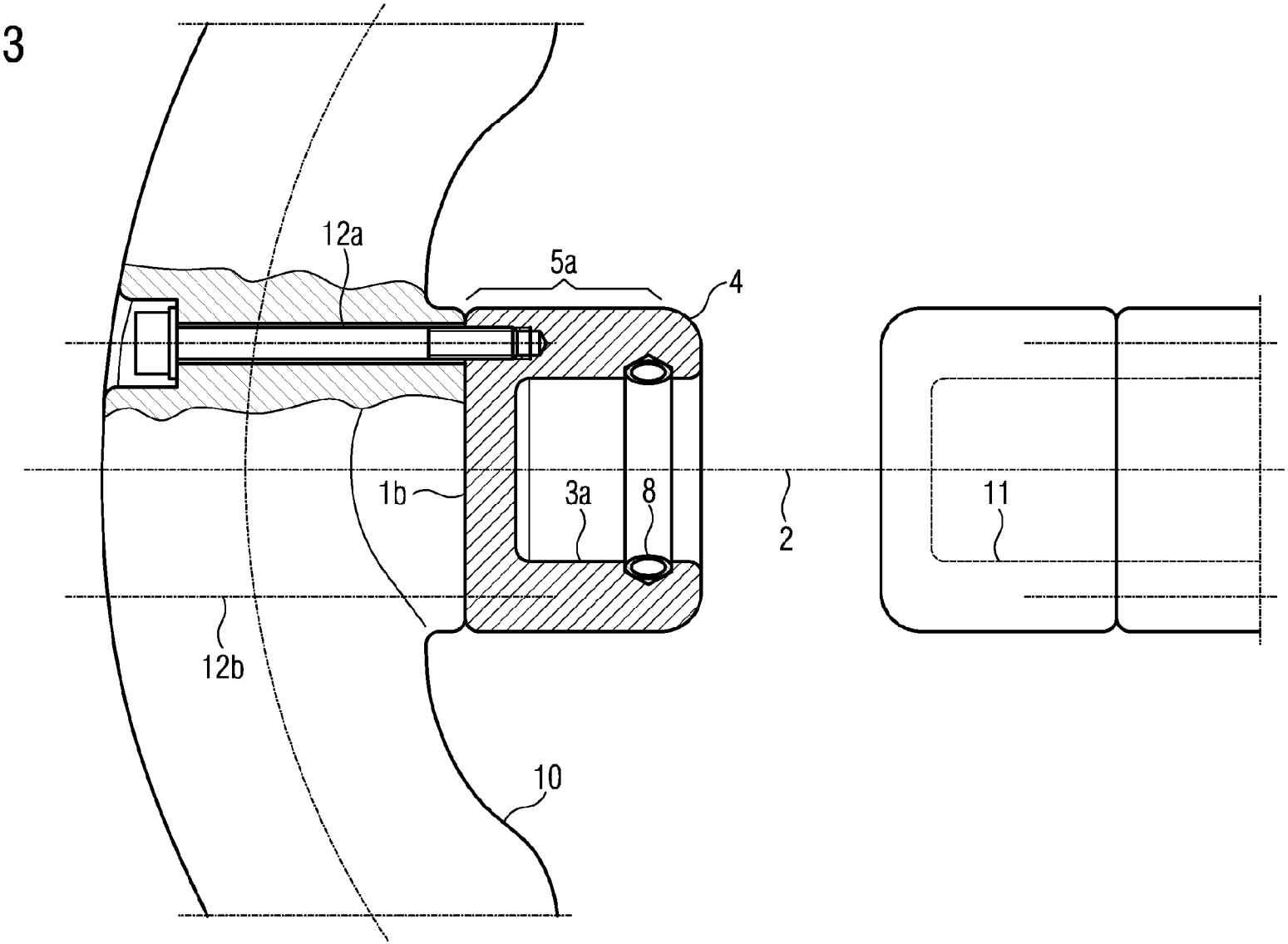
FIG. 3 shows a cross section through an electrical contact element in a third embodiment mounted on a conductor.

FIG. 3 shows a section through an electrical contact element in a third embodiment, wherein the contact element shown in FIG. 3 has a rectangular base surface 1*b* which is encompassed by a sleeve surface 5*a*. The sleeve surface 5*a* is the sleeve surface of a prism, in the present case a prism with a bulbous rectangular base surface, the corners of which are eradicated and which from the base surface 1*b* to the spherical top surface 4 transforms into a prism with circular cross section and merges with the top surface 4 in the course of the primary axis 2. As a result of the continuous transition, the rounded eradicated corners or rounded body edges on the base surface 1*b* are increasingly blurred so that the sleeve surface which is connected to the spherical top surface 4 has a section of a sleeve of a circular cylinder. Furthermore, unlike the embodiments of an electrical contact element known from FIGS. 1 and 2, with the third embodiment according to FIG. 3, it is provided that the contact bushing 3*a* is designed here as an opening in the manner of a blind hole. The electrical contact element in the third embodiment is therefore mechanically stabilized above the base surface 1*b* by a closed base. The third embodiment of the electrical contact element is pressed against a conductor 10 by means of the base surface 1*b*. A contact surface of the conductor 10 is formed equal and opposite to the base surface 1*b* of the electrical contact element of the third embodiment. The contact surface has the same dimensions as the base surface 1*b*. The contact surface is located on a skirt-shaped molding of the conductor 10. At the same time, the skirt-shaped molding takes on the form of the sleeve surface 5*a* of the contact element and forms a dielectrically favorably rounded transition to the conductor 10. Furthermore, it is shown in FIG. 3 that threaded bolts 12*a*, 12*b* penetrate the conductor 10 and project into threaded holes of the electrical contact element, thus effecting a contact force between conductor 10 and electrical contact element.

An application of an electrical contact element in an isolating switch is shown in FIG. 3. Here, the isolating switch has a contact pin 11 which extends coaxially with respect to the primary axis 2 and can be moved towards the primary axis 2. At the same time, the cross section of the contact pin 11 corresponds to the cross section of the contact bushing 3*a* and of the contacting element 8 inserted therein. The contact pin 11 can be moved into the contact bushing 3*a* where it makes contact with the contacting element 8 on the sleeve side. The contacting element 8 constitutes a part of an electrically conducting current path between the conductor 10 and the contact pin 11. At the same time, the electrically conducting current path is formed from the conductor 10 via the base surface 1*a*, the contact bushing 3*a* and the inserted contacting element 8 to the sleeve surface of the contact pin 11. It can be provided that the contact pin 11 can be repeatedly moved into and out of the contact bushing 3*a* so that an electrically conducting connection between the contact pin 11 and the conductor 10 can be repeatedly made and broken. In the diagram of FIG. 3, the contact pin 11 is in its switched-off position, wherein the contact pin 11 is encompassed by a guide device which also provides a dielectric screening thereof.

Figure 4:
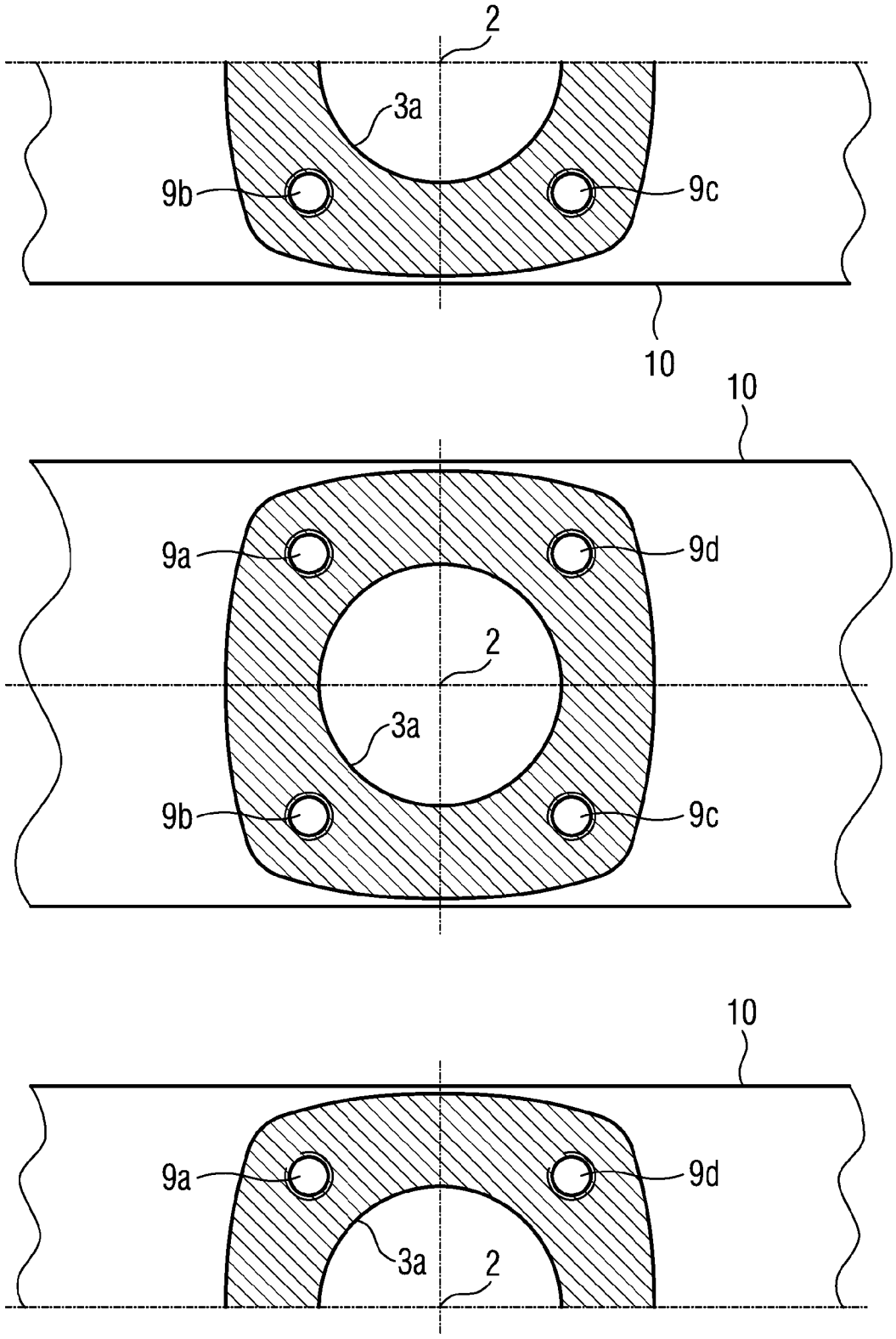
FIG. 4 shows the arrangement in principle of a plurality of electrical contact elements on a plurality of conductors of a multi-phase electrical power transmission system.

FIG. 4 shows a plan view on a plurality of electrical contact elements in the third embodiment known from FIG. 3, wherein three identically constructed electrical contact elements of the third embodiment are in each case fixed to a conductor 10, wherein each of the conductors 10 is formed in the same way. The contact elements are used to transmit a multi-phase alternating voltage system. For clarity, the electrical contact elements of the third embodiment are shown in FIG. 4 in a section so that threaded holes 9*a*, 9*b*, 9*c*, 9*d* are all visible.

Figure 5:
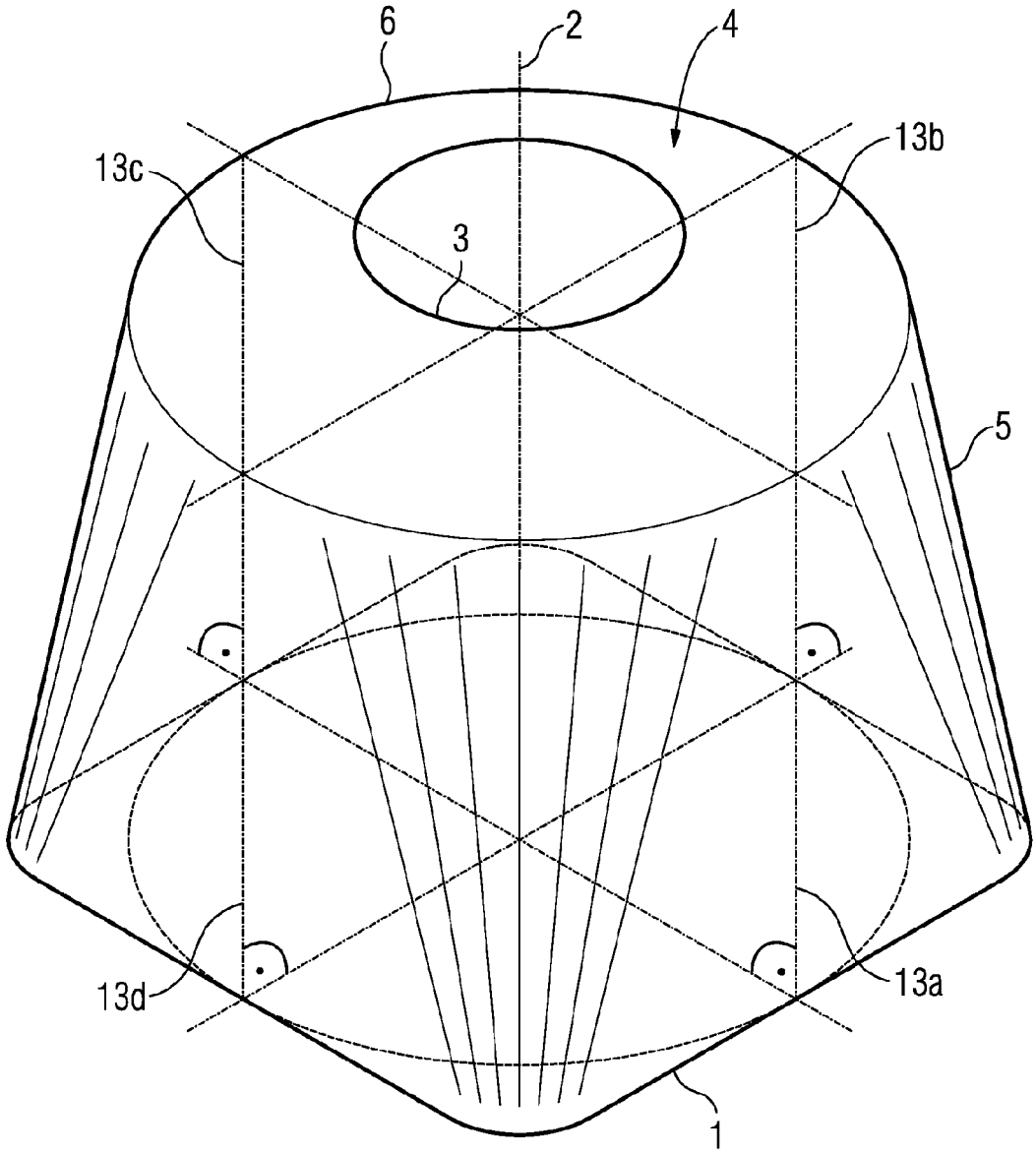
FIG. 5 shows the first embodiment of the contact element in a wire frame model.

In addition, FIG. 5 shows the first embodiment of a contact element schematically as a wire frame model in order to clarify the axis positions. It can be seen that the rectangular base surface 1 is penetrated by the primary axis 2 at right angles. Starting from the base surface 1, the sleeve surface 5 of the electrical contact element extends initially in the form of a sleeve surface of a truncated pyramid towards the spherical top surface 4 starting from the base surface 2 towards the spherical top surface 4 which has an ellipsoidal shape. Here, the top surface is a spherical cap which has a circular cross section. The orifice of the contact bushing 3 is arranged in the spherical cap. The diameter of the contour line 6, which is part of the spherical top surface, is equal to the length of the side of the base surface 1. Medians 13*a*, 13*b*, 13*c*, 13*d*, which are perpendicular to the base surface 1, project from the base surface 1. These medians 13*a*, 13*b*, 13*c*, 13*d* also subdivide the sections which lie between the body edges of the sleeve surface 5. The medians lie in a sleeve surface of an imaginary cylinder which extends coaxially with respect to the primary axis 2, wherein the perpendicular bisectors are aligned parallel to the primary axis 2.

In an alternative, the contour line 6, i.e. the cross section of the ellipsoid, has a smaller extension than the length of the side of the base surface 1 so that, in the case of a continuous transition of the sleeve surface between base surface 1 and spherical top surface 4, the perpendicular bisectors 13*a*, 13*b*, 13*c*, 13*d* shown in FIG. 5 lie in the sleeve surface and are not arranged perpendicular to the base surface 1, but run at an angle to a notional point of intersection.

Basically, the embodiments shown in the individual figures can be varied with regard to the design of sleeve surfaces, contacting elements, contact bushings, threaded holes etc. without changing the character of the invention. In particular, by way of example, the degree of curvature of the spherical top surfaces 4, radial extensions of the spherical top surface or the slope of the sleeve surface can vary.

The invention claimed is:

1. An electrical contact element, comprising:

a polygonal base surface;

a primary axis piercing said polygonal base surface; and a contact bushing disposed around said primary axis and having a top surface and a orifice formed therein, said orifice of said contact bushing opening into said top surface disposed on a side of the contact element lying opposite to said polygonal base surface, said top surface being spherically curved and spans said polygonal base surface, said contact bushing having an outer surface connecting said polygonal base surface to said top surface and merges continuously from said polygonal base surface into said top surface being a spherical top surface, said outer surface completely surrounding all space between said polygonal base surface and said top surface in a stepless manner.

2. The electrical contact piece according to claim 1, wherein on a side facing said polygonal base surface, said outer surface is configured at least partially in a manner of an outer surface of a truncated pyramid, and said spherical top surface, rounded in a manner of an ellipsoid, merges continuously with said outer surface of said truncated pyramid and defines body edges.

3. The electrical contact element according to claim 2, wherein a continuous transition to said spherical top surface takes place using sections which lie on said outer surface of a circular cylinder.

4. The electrical contact element according to claim 2, wherein said body edges are formed in a rounded manner.

5. The electrical contact element according to claim 1, wherein on a side facing said base surface, said outer surface is configured at least partially in a manner of an outer surface of a prism, and said spherical top surface, rounded in a manner of an ellipsoid, merges continuously with said outer surface of said prism and defines body edges.

6. The electrical contact element according to claim 1, wherein said outer surface is curved concavely.

7. The electrical contact element according to claim 1, wherein said polygonal base surface and said top surface are connected to one another in one piece.

8. The electrical contact element according to claim 1, wherein said polygonal base surface and said top surface are electrically conducting.

9. The electrical contact element according to claim 1, wherein said contact bushing opens into both said top surface and into said base surface.

10. An electrical contact element, comprising:

a polygonal base surface, said polygonal base surface having threaded holes formed therein, a number of said threaded holes corresponding to a number of corners of said polygonal base surface;

a primary axis piercing said polygonal base surface; and a contact bushing disposed around said primary axis and having a top surface and a orifice formed therein, said orifice of said contact bushing opening into said top surface disposed on a side of the contact element lying opposite to said polygonal base surface, said top surface being spherically curved and spans said polygonal base surface, said contact bushing having an outer surface connecting said polygonal base surface to said top surface and merges continuously from said polygonal base surface into said top surface being a spherical top surface.

* * * * *